US008607974B2

(12) United States Patent
de The et al.

(10) Patent No.: US 8,607,974 B2
(45) Date of Patent: Dec. 17, 2013

(54) PACK FOR SMOKING ARTICLES

(75) Inventors: Tanneguy Blaudin de The, Tours (FR); John England, Mamaroneck, NY (US); Steven Holford, London (GB)

(73) Assignee: British America Tobacco (Holdings) Limited, London (GB)

( * ) Notice: Subject to any disclaimer, the term of this patent is extended or adjusted under 35 U.S.C. 154(b) by 0 days.

(21) Appl. No.: 12/341,810

(22) Filed: Dec. 22, 2008

(65) Prior Publication Data

US 2010/0155274 A1 Jun. 24, 2010

(51) Int. Cl.
*B65D 85/10* (2006.01)

(52) U.S. Cl.
USPC ..... 206/273; 220/674; 53/461

(58) Field of Classification Search
USPC ..... 206/242–276; 220/674, 669, 645, 670; 229/199, 919, 160.1; D27/186; 493/467; 53/461
See application file for complete search history.

(56) References Cited

U.S. PATENT DOCUMENTS

| | | | | |
|---|---|---|---|---|
| 3,327,887 | A | 6/1967 | Walker | |
| 3,388,706 | A * | 6/1968 | Muirheid | 131/238 |
| D218,793 | S | 9/1970 | Rushlow | |
| 3,596,758 | A * | 8/1971 | Phillips et al. | 206/273 |
| 4,895,251 | A * | 1/1990 | Focke et al. | 206/273 |
| 5,277,315 | A * | 1/1994 | Plein | 206/270 |
| 5,762,230 | A * | 6/1998 | Policappelli | 220/674 |
| 5,826,785 | A | 10/1998 | Belvederi | |
| 6,126,013 | A * | 10/2000 | Miller | 206/591 |
| 6,168,014 | B1 | 1/2001 | Manservigi et al. | |
| 6,216,860 | B1 * | 4/2001 | Boriani et al. | 206/273 |
| 6,364,106 | B1 * | 4/2002 | Fagg et al. | 206/273 |
| D474,856 | S | 5/2003 | Hatto | |
| 7,025,201 | B2 * | 4/2006 | Draghetti et al. | 206/273 |
| 7,377,399 | B2 * | 5/2008 | Lane et al. | 220/675 |
| 2003/0164314 | A1 | 9/2003 | Bray | |
| 2004/0026272 | A1 * | 2/2004 | Conti et al. | 206/261 |
| 2004/0144661 | A1 * | 7/2004 | Lutzig | 206/273 |
| 2004/0217023 | A1 * | 11/2004 | Fagg et al. | 206/242 |
| 2005/0155878 | A1 * | 7/2005 | Pham | 206/271 |
| 2006/0255111 | A1 | 11/2006 | Bray et al. | |
| 2010/0059395 | A1 * | 3/2010 | England | 206/273 |
| 2010/0126889 | A1 | 5/2010 | Holford | |

FOREIGN PATENT DOCUMENTS

| | | |
|---|---|---|
| CL | 1683-1998 | 12/1998 |
| CL | 1188-2001 | 9/2002 |
| CL | 1820-2003 | 6/2004 |

(Continued)

OTHER PUBLICATIONS

Chinese Office Action issued Sep. 13, 2012 for corresponding Chinese Patent Application 200980151978.5, filed Nov. 19, 2009 (with English translation).

(Continued)

*Primary Examiner* — Andrew Perreault
(74) *Attorney, Agent, or Firm* — NW Poulsen

(57) ABSTRACT

The disclosure addresses aspects of a PACK FOR SMOKING ARTICLES, wherein smoking articles may include, but are not limited to, cigarettes and the like. This disclosure details a pack for smoking articles comprising a plurality of planar panels, and a blank for producing such a pack. In one embodiment, at least one of the panels includes a plurality of formations extending out of the plane of a surface of the panel(s). In one non-limiting implementation, the formations may provide protection for the contents of the pack from subsequent processes performed thereon.

39 Claims, 21 Drawing Sheets

(56) References Cited

FOREIGN PATENT DOCUMENTS

| | | | |
|---|---|---|---|
| CL | 504-2004 | | 12/2004 |
| CL | 071-2008 | | 7/2008 |
| CL | 1160-2008 | | 11/2008 |
| CN | 1163389 | A | 8/2004 |
| CR | 7077 | S | 9/2008 |
| DE | 658385 | C | 3/1938 |
| EP | 0900736 | A2 | 3/1999 |
| EP | 0940354 | A1 | 9/1999 |
| FR | 1058709 | A | 3/1954 |
| GB | 2311762 | | 10/1997 |
| JP | 10-211973 | | 8/1998 |
| WO | 0056475 | A1 | 9/2000 |
| WO | 2005066029 | A1 | 7/2005 |
| WO | 2005087595 | A1 | 9/2005 |
| WO | 2006067624 | | 6/2006 |
| WO | 2008134779 | | 11/2008 |

OTHER PUBLICATIONS

Chilean Office Action for corresponding Chilean Patent Application 2011-001543, filed Jun. 21, 2011 (with machine translation into English).

Patent Examination Report dated Mar. 15, 2013 for corresponding Australian patent application 2009331816, filed Jul. 31, 2012.

Examination Report dated Aug. 15, 2012 for corresponding New Zealand patent application 593247.

International Search Report, mailed Jan. 27, 2010, for International Patent Application PCT/EP2009/065463, filed Nov. 19, 2009.

Written Opinion, dated Jan. 26, 2010, for International Patent Application PCT/EP2009/065463, filed Nov. 19, 2009.

International Preliminary Report on Patentability, mailed Feb. 8, 2011, for International Patent Application PCT/EP2009/065463, filed Nov. 19, 2009.

* cited by examiner

PACK FOR SMOKING ARTICLES

FIELD

The present invention is directed generally to packaging, and specifically to a PACK FOR SMOKING ARTICLES, particularly but not exclusively a pack for cigarettes.

BACKGROUND

Conventional packs for cigarettes may be fabricated from a blank of board, for example cardboard, that comprises front and rear panels connected by opposite side panels, a bottom panel and a lid. The surfaces of such packs are generally smooth. Heat is applied to packs during the manufacturing and packaging process, for example, during the packaging process involving wrapping the pack in a clear plastic wrapping of polypropylene or the like. This wrapping is sealed in place by heating elements pressed against the wrap on the pack surface, or by the whole pack being passed through a heating station containing heating elements, which heat the wrapping to shrink-wrap the wrapping onto the pack.

SUMMARY

During the manufacturing and packaging process of conventional packs, the smoking articles, and in particular the tobacco contained therein, may be adversely affected by the heat which the pack is subjected to (e.g., from the heat-sealing of the wrapper, etc.). This heat can adversely affect the smoking articles, including causing moisture loss from the smoking articles contained in the pack, degrading the quality and shelf life of the smoking articles. Another drawback of conventional packs is that a user, during opening and subsequent use of the pack, may have a low purchase on the conventional pack due to the smooth-faced walls of the pack.

This disclosure discusses aspects of a pack for smoking articles, one object which is to provide pack for smoking articles which substantially alleviates or overcomes the problems mentioned above. According to one embodiment, there is provided a pack for smoking articles comprising a plurality of planar panels, wherein at least one of the panels includes a plurality of formations extending out of the plane of a surface of the or each panel.

In some embodiments of the invention, the pack may comprise front and rear panels connected by opposite side panels a bottom panel and a top panel, and at least one of the front and/or rear panels may include the plurality of formations.

In some embodiments, both the front and rear panels may include said formations, and/or the side panels may include said formations. In further embodiments, the top panel may include said formations, and/or the bottom panel may include said formations. In one embodiment, the top panel comprises a lid, and in one implementation, the lid comprises a flip top.

In some embodiments, the formations may be embossed and the pack may be fabricated from sheet material and the formations may be formed in the thickness of the sheet material. The sheet material may include, but is not limited to, cardboard and/or like materials.

In one implementation, formations may be formed on substantially the entire surface area of the panel(s), while in another implementation, formations may be formed on only a portion of the surface area of the panel(s).

In some embodiments, the plurality of formations may comprise protuberances projecting from a surface of one or more of the panels. Depending on the implementation, the protuberances may project from the outer surface(s) of the panel(s), from the inner surface(s) of the panel(s), and/or from both the outer surface(s) and the inner surface(s) of the panel(s).

In some embodiments, the or each panel may include between 5-2000 protuberances, and may include between 10-1000 protuberances, and may include between 50-750 protuberances.

All of the protuberances may, in some embodiments, project from the surface(s) of the panel(s) by the same distance. In some implementations, the protuberances may be generally circular and convex in shape.

In one implementation, the protuberances may be formed in regular rows and columns on the panel surface(s).

The pack may also include an outer wrapper spaced from the surface of the panel(s) of the pack by said protuberances.

The plurality of formations may also comprise depressions extending into a surface of the or each panel. The depressions may extend into the outer surface(s) of the panel(s), or the depressions may extend into the inner surface(s) of the panel(s), or the depressions may extend into both the outer surface(s) and the inner surface(s) of the panel(s).

In some embodiments, the or each panel may include between 5-2000 depressions, and may include between 10-1000 depressions, and may include between 50-750 depressions.

The depressions may, in some embodiments, all extend into the surface(s) of the panel(s) by the same distance. In some implementations the depressions may be generally circular and concave in shape.

In one implementation, the depressions may be formed in regular rows and columns on the panel surface(s).

In some embodiments, the pack may further include an inner frame within the pack, and the pack may comprise a front panel which includes a cut-out portion which exposes a portion of the inner frame. In one embodiment, the exposed portion of the inner frame may be printed with indicia or graphics.

Depending on the implementation, the corner edges of the pack may be beveled, curved, and/or rectangular.

In one embodiment, the pack may contain smoking articles. Smoking articles may comprise, but are not limited to, cigarettes.

In one implementation, the pack may include both protuberances and depressions as described above, formed in one or more of the plurality of panels.

The present invention also provides a blank for fabricating a pack for smoking articles, comprising a plurality of planar panel portions, wherein at least one of the panel portions includes a plurality of formations extending out of the plane of a surface of the or each panel portion.

In some implementations, the blank comprises front and rear panel portions, side panel portions, a bottom panel and portion to form a lid, wherein at least one of the front and/or rear panel portions may include the plurality of formations.

The plurality of formations may comprise protuberances projecting from a surface of an at least one panel portion, and/or the plurality of formations may comprise depressions extending into a surface of an at least one panel portion.

The present invention also provides a method of fabricating a pack for smoking articles from a blank comprising a plurality of planar panel portions, the method comprising forming in at least one of the panel portions a plurality of formations extending out of the plane of a surface of the or each panel portion.

In one embodiment, the method includes embossing the blank to form the formations.

In some embodiments, the method may include feeding successive ones of the blank from a magazine thereof to an embossing station to form said formations, and feeding the embossed blanks to a cigarette packaging machine to be formed into packs filled with cigarettes.

In one implementation, the blank may comprise front and rear panel portions, side panel portions, a bottom panel and portion to form a lid, wherein the formations may comprise protuberances projecting from a surface of the or each panel portion.

The method may include wrapping the pack in an outer wrapping subsequent to the packs being filled with cigarettes, sealing the wrapping onto the pack using heat from a heater element and forming an air gap between the wrapping and the surface of the pack by the plurality of protuberances spacing the wrapping from the pack surface.

In the method, the blank may comprise front and rear panel portions, side panel portions, a bottom panel and portion to form a lid, wherein the formations may comprise depressions extending into a surface of the or each panel portion.

The method may include wrapping the pack in an outer wrapping subsequent to the packs being filled with cigarettes, sealing the wrapping onto the pack using heat from a heater element and forming a plurality of air gaps between the wrapping and the surface of the pack within the plurality of depressions spacing the wrapping from the pack surface.

As used herein, the term "smoking article" includes, but is not limited to, smokable products such as cigarettes, cigars and cigarillos whether based on tobacco, tobacco derivatives, expanded tobacco, reconstituted tobacco or tobacco substitutes and also heat-not-burn products. The smoking article may be provided with a filter for the gaseous flow drawn by the smoker.

In order that the invention may be more fully understood, embodiments of the invention are described, by way of illustrative example only, with reference to the accompanying figures.

DETAILED DESCRIPTION

Figure 1:
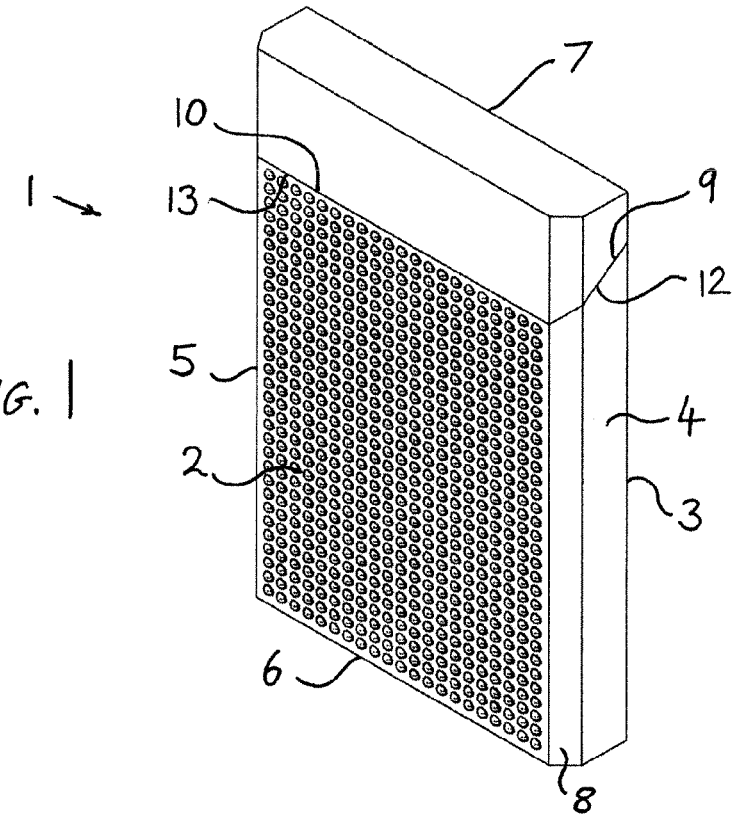
FIG. 1 is a schematic perspective view of a cigarette pack of a first embodiment of the invention from the front and one side with its lid closed.
Figure 2:
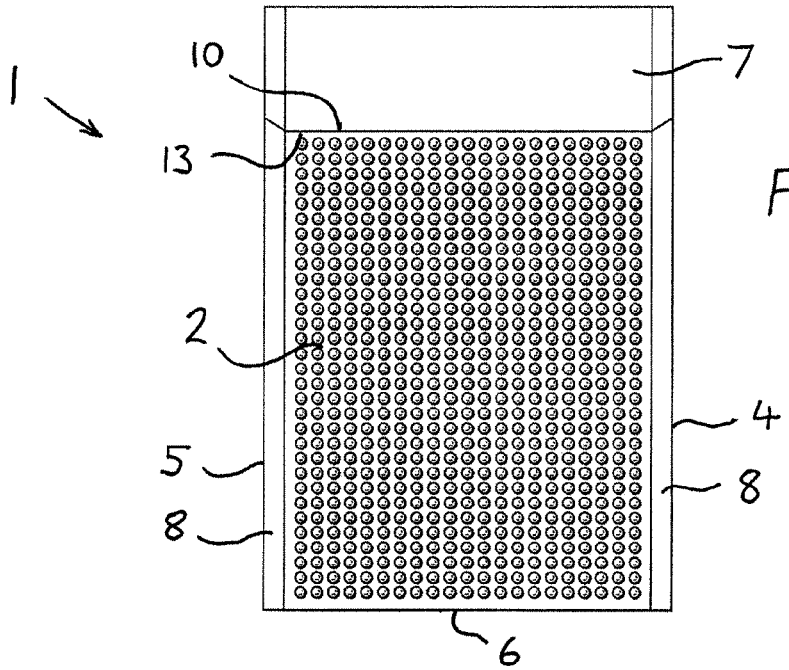
FIG. 2 is a front view of the pack of FIG. 1.
Figure 3:
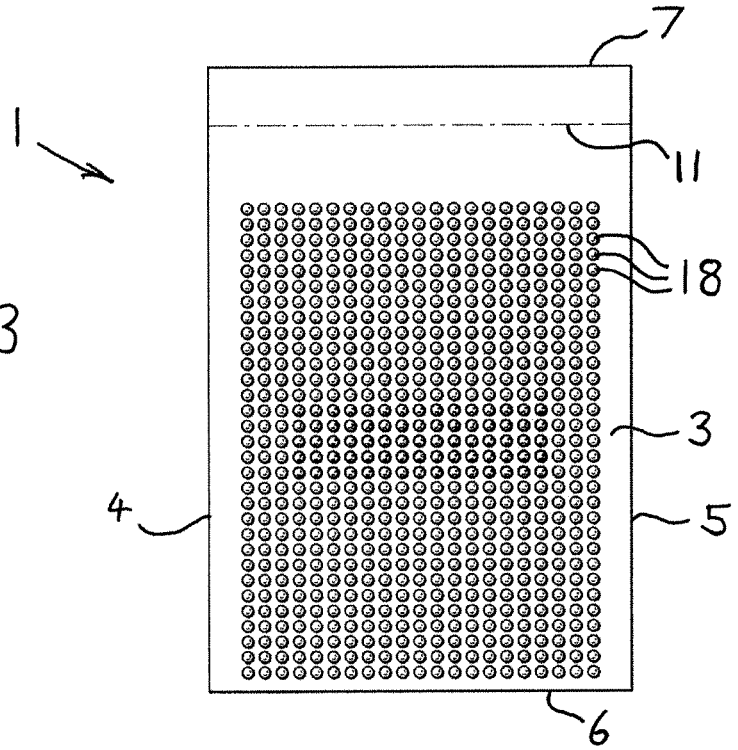
FIG. 3 is a rear view of the pack of FIGS. 1 and 2.
Figure 4:
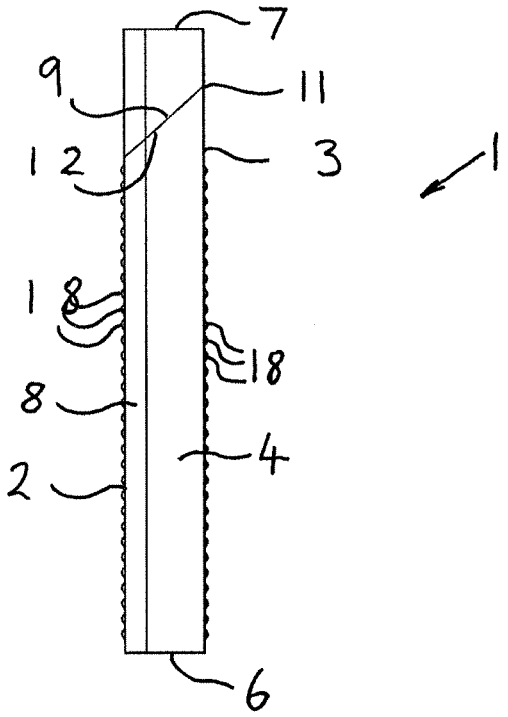
FIG. 4 is a side view of the pack of FIGS. 1 to 3.
Figure 5:
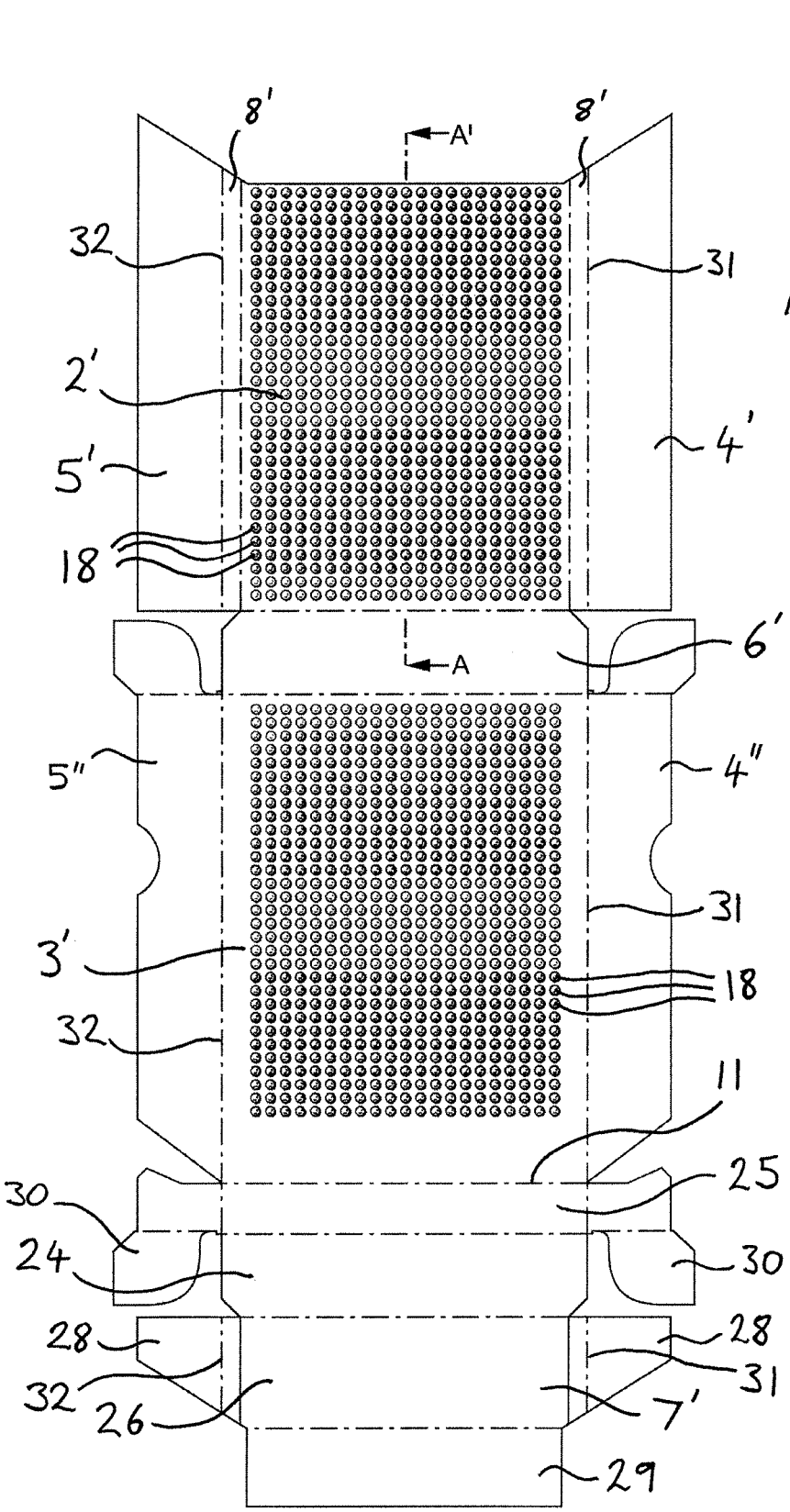
FIG. 5 is a schematic illustration of a blank used for fabricating the pack shown in FIGS. 1 to 4.

Referring to FIGS. 1 to 4, a flip-top pack 1 for cigarettes of a first embodiment of the invention is formed from a blank, shown in FIG. 5, and comprises front panel 2, rear panel 3, side panels 4, 5, a bottom panel 6 and a hinged lid 7, all formed by folding and gluing selected portions of the blank shown in FIG. 5, formed of board stock sheet material such as cardboard.

The pack has longitudinally extending beveled edge portions 8 along the joins between the side panels 4, 5 and the front and rear panels 2, 3.

The lid 7 has sloping side edges 9 and a front edge 10 which in a closed position is lower than hinge line 11 for the lid, and the upper edges 12, 13 of the front and side panels 2, 4, 5 are correspondingly shaped to provide a close fit when the lid is shut. As shown in FIGS. 1-4, the pack is a slim pack designed to contain slim or superslim cigarettes, although the invention is not limited to such pack dimensions, and could equally apply to packs for different sizes of cigarette of other smoking article, as well as packs designed to contain different numbers of smoking articles. In the embodiment shown, and as well known in the art, the sloping arrangement of the lid 7 provides improved access to the cigarettes when the lid is opened.

An inner frame (not shown) of board stock sheet material such as cardboard is fitted within the upper part of the opening of the container e.g. by gluing and includes a re-entrant part to provide user access to the cigarettes. The inner frame is of a shape to bound the interior of the front and side panels 2, 3, 4 along with the beveled edges 8 adjacent the front panel so as to act as a jam against which the lid 7 can abut when closed, with its exterior surface co-extensive with the front and side panels 2, 4, 5. The inner frame includes depending flanges which act as stops to hold the lid 7 when closed.

The front and rear panels 2, 3 include a plurality of circular convex protuberances 18 in the form of raised domes, which project outward from the base surface 2*a*, 3*a* of each panel 2,3 (measured a distance 't' from the back side of the panels 2, 3). This can be seen more clearly in FIGS. 6 and 9 which show a cross-sectional view of a portion of the front panel 2. The protuberances 18 are arranged in rows and columns and cover substantially the entire surface area of the front and rear panels 2, 3. The protuberances 18 may be formed by embossing the surface of the panels 2, 3 (when in the form of the blank), as will be described in more detail later. However, other techniques can be used, for example to compress the board material between the protuberance locations to create the plurality of projecting domes extending from the planar surface of the panels 2, 3.

Figure 6:
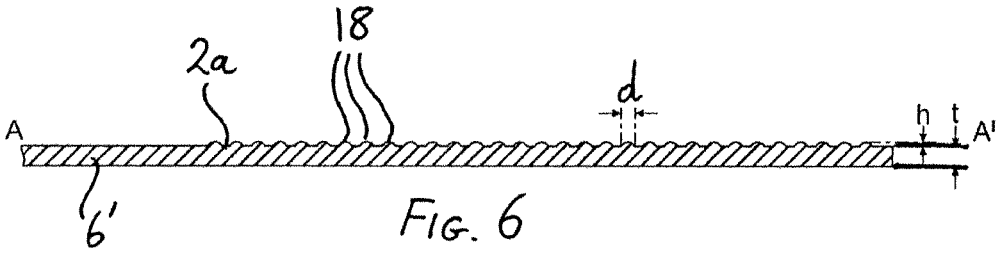
FIG. 6 is a partial cross-sectional view taken along the line A-A' in FIG. 5.
Figure 9:
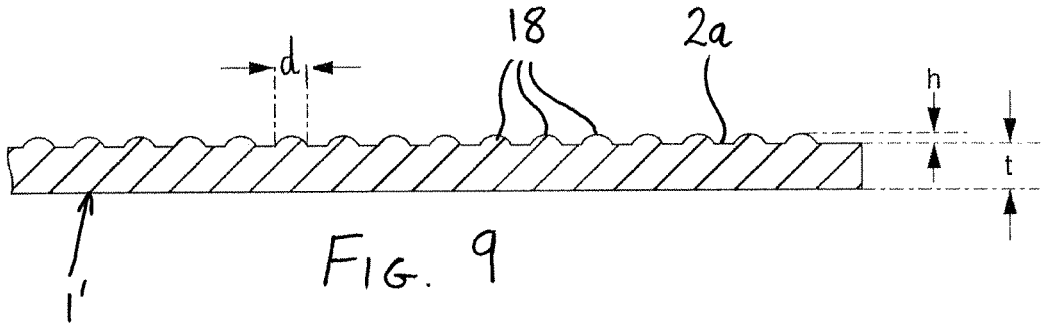
FIG. 9 is an enlarged view of a portion of the cross-section of the blank shown in FIG. 6.

The protuberances can vary in size and shape within the scope of the invention, but in the illustrated exemplary embodiment, it can be seen from FIGS. 6 and 9 that they have a diameter d which is typically of the order of 1.0-1.5 mm, and a height h which is typically of the order of 0.1-0.2 mm, measured from the base surface 2*a*, 3*a* of the front and rear panels 2, 3. The number of protrusions on each panel may also vary within the scope of the invention, and may be from 5-2,000, conveniently from 10-1,000 and more conveniently from 50-750.

The protuberances 18 have the effect of spacing an outer wrapper 19 of the pack from the base surfaces 2*a*, 3*a* of the panels 2, 3 to create an air gap between the wrapper surface and the panel surfaces 2*a*, 3*a*. During packaging of the pack, once the blank has been constructed and closed with the smoking articles contained within the pack, the pack is wrapped in a wrapper 19, typically made of polypropylene. During the wrapping process, heater elements are used to seal the polypropylene wrapper around the pack, to keep the contents of the pack as fresh as possible. The process by which the pack wrap is sealed can vary. In one process, the pack is wrapped with the polypropylene wrapping and heating elements are applied directly to the surfaces at the wrapper joins, to seal the wrapper onto the pack. In another process, the pack is wrapped in polypropylene wrapping and then passed through a heating station to heat the wrapping to shrink-fit it to the pack. In both processes, however, the heat generated by the heating elements can adversely affect the smoking articles contained in the pack. For example, the heat can dry the tobacco and the moisture loss degrades the quality of the smoking articles and reduces their shelf life.

In conventional packs with flat-faced panels, the heat from the heater elements may be readily conducted through the panel of the pack and directly to the smoking articles contained within the pack. This is primarily because the panel is flat and so the entire surface area of the panel is in contact with the wrapper surface and so the heat is conducted from the heater element through the wrapper 19 to the entire panel surface. However, in the pack of the present invention, the protuberances 18 space the wrapper material from the surface of the panels, creating an air gap therebetween and significantly reducing the surface area over which the wrapper 19 contacts the panels. Therefore, the surface area available for heat to be conducted to the pack is significantly reduced, and the air gap between the wrapper surface and the panel base surface 2*a*, 3*a* between the protuberances 18 further acts as an insulating air gap. The effect of this is to greatly reduce the heat transfer from the heater elements and ambient environment to the pack, and thereby to the smoking articles contained within the pack, thus significantly limiting any adverse effect of heat on the quality of the smoking articles contained in the pack. As the protuberances in the described embodiment are all of the same height, and in sufficient numbers, they effectively provide a surface, albeit a discontinuous surface, spaced from the base surfaces 2*a*, 3*a* of the panels 2, 3, against which the wrapping is placed. Furthermore, the discontinuous surface provided by the plurality of protuberances does not adversely affect the ease with which the pack may be wrapped by conventional cigarette wrapping machinery.

In addition to the heat-insulation benefits provided by the protuberances 18 described above, the protuberances 18 also provide a tactile gripping surface on the exterior of the pack which assists the user in gripping the pack and opening the lid 7.

The card used in the pack may have a weight of 180-300 g/squ.m, more typically 200-280 g/squ.m, for example 240 g/squ.m, although a lighter material may be used, for example 215 g/squ.m. or even 200 g/squ.m. The card is typically of the order of 0.3 mm thick and the depth of the embossing that forms the protuberances may be of the order of 50% of the un-bossed card thickness.

Figure 7:
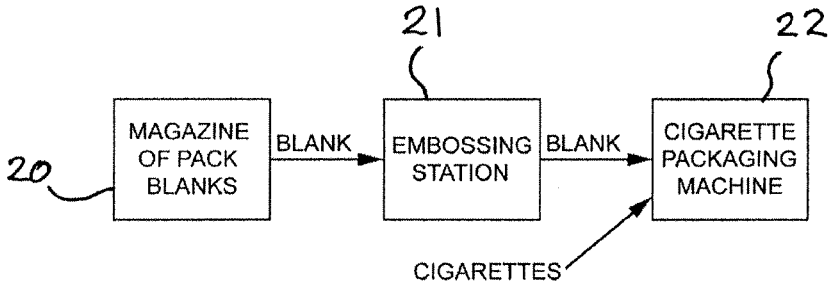
FIG. 7 is schematic illustration of a facility for packaging cigarettes in a pack as shown in FIGS. 1 to 4.
Figure 8:
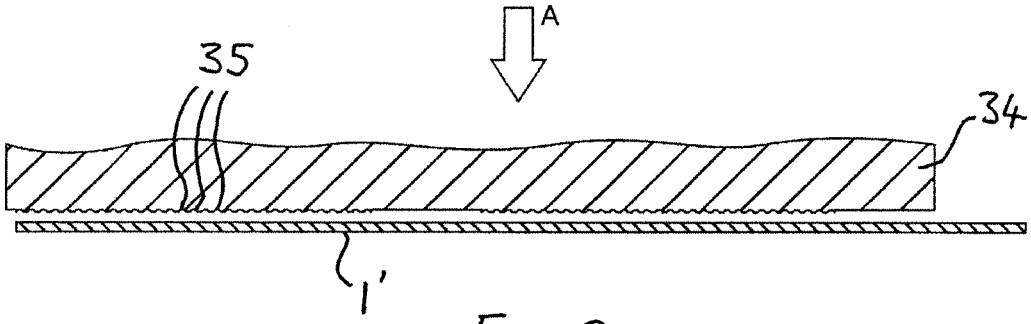
FIG. 8 is a schematic illustration of an embossing station for use in the facility shown in FIG. 7.

A method of packaging cigarettes in the pack will now be described with reference to FIGS. 7 and 8. A magazine 20 as shown in FIG. 7 contains a plurality of blanks 1' substantially as illustrated in FIG. 5 but without the protuberances 18. The blanks 1' may be pre-printed and pre-formed with lines of folding in a manner well known in the art. Individual blanks are conveyed sequentially to an embossing station 21 at which the protuberances 18 are embossed onto the pre-printed blank 1'. Thereafter, the blanks 1' are fed to a cigarette packaging machine 22 that is fed with a supply of cigarettes. The cigarette packaging machine 22 folds the blank 1' so as to form the pack 1 and fills it with cigarettes wrapped in foil (not shown).

In order to form the pack, the packaging machine 22 operates in a manner known to those in the art, so as to fold the blank shown in FIG. 5 along the hatched fold lines in order to create the pack. The blank 1' comprises a front panel portion 2' and a rear panel portion 3' that are connected by a base panel portion 6'. The lid is formed of a lid panel portion 7' that has a lid top 24, a lid rear panel 25, lid front panel 26 and re-entrant flaps 28-30 which can be folded inwardly to create the lid structure shown in FIGS. 1 to 4.

The side walls 4, 5 of the pack are formed from panel portions 4', 4", 5', 5" that depend from the front and rear panel portions 2', 3' respectively. When the pack is folded, the panel portions 4', 4" and 5', 5" overlie one another and are glued together to form the side panels 4, 5.

The beveled edges 8 are created from regions 8' by folding along hatched fold lines 31, 32. When assembled, the lid 7 can hinge along hinge line 11.

Initially, the blank may be pre-printed with trading and user information but is without the protuberances. They are applied subsequently at the embossing station 21, which may utilize an embossing tool 34 as illustrated in FIG. 8. Here, the pre-printed blank 1' is placed in alignment with an embossing tool 34 (shown in section) which is moved in the direction of arrow A in order to emboss the surface of the blank 1'. The tool 34 includes a series of concave dimples or recesses 35 that are a mirror of the eventual convex protuberances 18 formed in the blank which, when driven downwardly onto the blank 1', embosses the protuberances 18 into the blank to achieve the configuration shown in FIGS. 1 to 6 and 9.

Thereafter, the embossed blank 1' is fed to the cigarette packaging machine 22 shown in FIG. 7 for assembly and filling with cigarettes as previously described.

Figure 12:
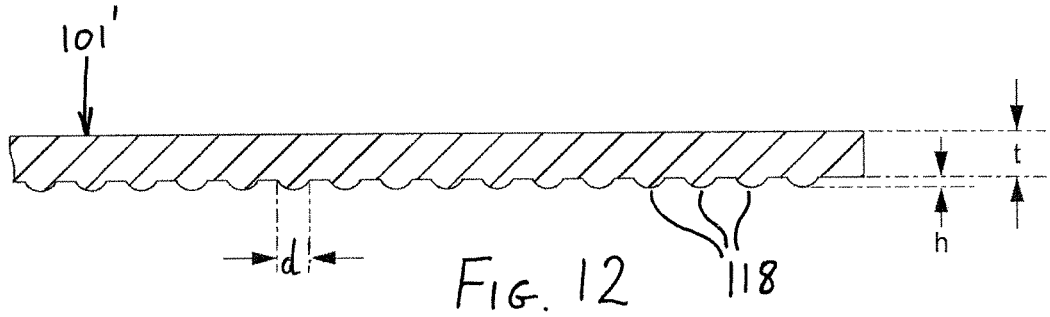
FIG. 12 is an enlarged view of a portion of the cross-section of the blank shown in FIG. 10.
Figure 10:
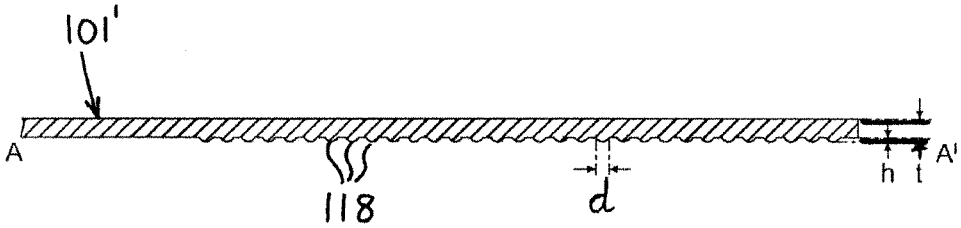
FIG. 10 is a partial cross-sectional view similar to that shown in FIG. 6, but of a blank of a second embodiment of the invention.
Figure 11:
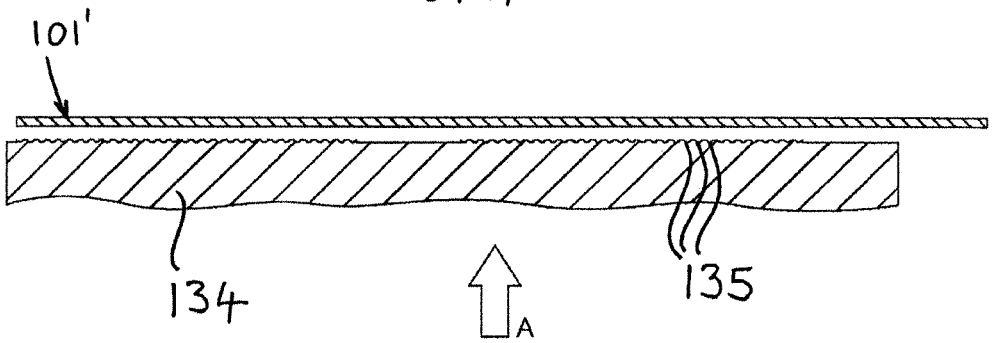
FIG. 11 is a schematic illustration of an embossing station similar to that shown in FIG. 8, but for use in producing the blank of the second embodiment of the invention shown in FIG. 10.

In the above-described example, the protuberances are shown and described as projecting outwardly from the outer surfaces of the panels of the pack, thereby affording the technical advantages of creating an insulating air gap between the pack surface and the wrapping to prevent heat degradation of the smoking articles. However, it is intended within the scope of the invention that the protuberances may project inwardly from the inside surface(s) of the panels of the pack. Such an alternative, second embodiment of the invention is shown in FIGS. 10 to 12, which illustrate a portion of a blank 101' similar to blank 1' of the first embodiment shown in FIG. 5. However, FIGS. 10 and 12 show that protuberances 118 in this second embodiment are formed on the opposite side of the blank 101' to those of the blank 1' of the first embodiment of the invention. Therefore, once the blank 101' of the second embodiment is folded to produce a cigarette pack, the protuberances 118 will be inwardly-projecting and will cause the foil-wrapped cigarettes, which are to be contained within the pack, to be spaced from the inside surface of the pack, thereby creating an insulating air-gap between the foil-wrapped cigarettes and the inside of the pack. This insulating air-gap helps to prevent the conduction of heat from the panels of the pack to the foil-wrapped cigarettes within the pack. This therefore prevents the problems described above with heat-degradation of the smoking articles from occurring.

As with the protuberances 18 of the first embodiment, the protuberances 118 of the second embodiment may be applied at an embossing station, which may utilize an embossing tool 134 as illustrated in FIG. 11. Here, the pre-printed blank 101' is placed in alignment with an embossing tool 134 (shown in section) which is moved in the direction of arrow A in order to emboss the surface of the blank 101'. The tool 134 includes a series of concave dimples or recesses 135 that are a mirror of the eventual convex protuberances 118 formed in the blank 101' which, when driven upwardly onto the blank 101', embosses the protuberances 118 into the blank 101' to achieve the configuration shown in FIGS. 10 and 12. The remaining steps of the method of packing cigarettes described above in relation to the first embodiment of the invention are equally applicable to the pack of the second embodiment of the invention.

Figure 15:
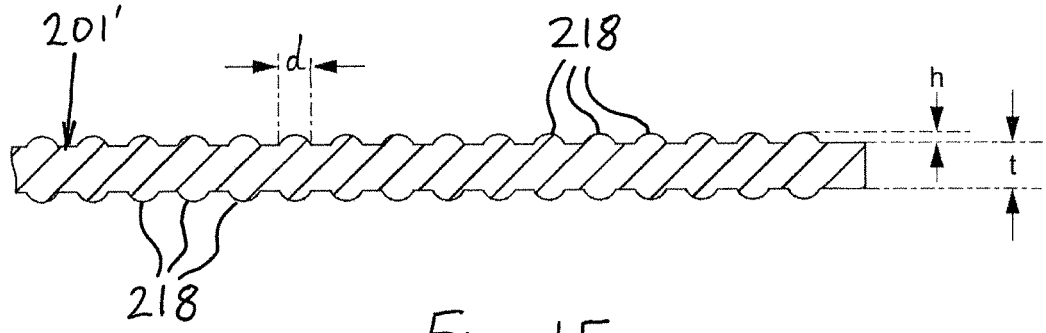
FIG. 15 is an enlarged view of a portion of the cross-section of the blank shown in FIG. 13.
Figure 13:
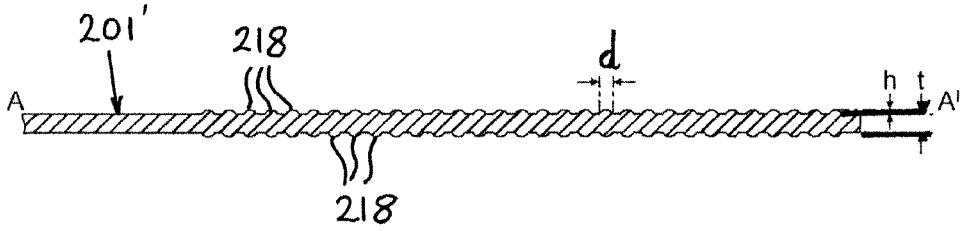
FIG. 13 is a partial cross-sectional view similar to that shown in FIG. 6, but of a blank of a third embodiment of the invention.
Figure 14:
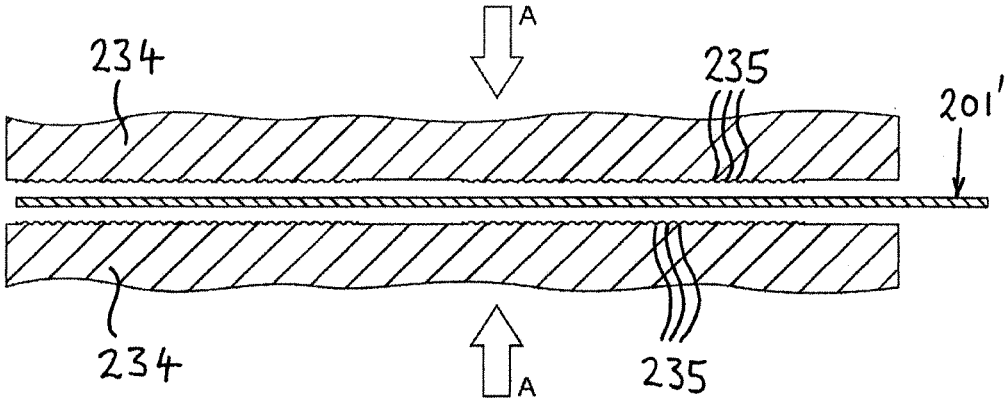
FIG. 14 is a schematic illustration of an embossing station similar to that shown in FIG. 8, but for use in producing the blank of the third embodiment of the invention shown in FIG. 13.

In the second embodiment shown in FIGS. 10 to 12, the inwardly-projecting protuberances 118 are provided in place of the outwardly projecting protuberances 18 shown and described in the first embodiment. However, the inwardly projecting protuberances 118 may be provided in addition to the outwardly-projecting protuberances 18, and such an embodiment, a third embodiment of the invention, is shown in FIGS. 13 to 15, which show a portion of a blank 201' similar to blank 1' of the first embodiment shown in FIG. 5. However, FIGS. 13 and 15 show that protuberances 218 in this third embodiment are formed on both sides of the blank 201', such that when the pack is folded and constructed, the pack has both inwardly and outwardly projecting protuberances 218 on the front and rear panels of the pack. This affords the third embodiment of the invention with the increased technical advantage of two air-gaps to insulate the cigarettes from the external heat source, namely a first air gap between the wrapping and the outer base surface of the panels provided by the outwardly-projecting protuberances, as with the first embodiment of the invention, and a second air gap provided between the inner base surface of the panels and the foil-wrapped cigarettes provided by the inwardly-projecting protuberances, as with the second embodiment of the invention.

As with the protuberances 18,118 of the first and second embodiments, the protuberances 218 of the third embodiment may be applied at an embossing station, which may utilize an embossing tool 234 as illustrated in FIG. 14. Here, the pre-printed blank 201' is placed in alignment with an embossing tool 234 (shown in section) which is moved in the direction of arrows A in order to emboss both of the surfaces of the blank 201'. The two parts of the tool 234 include a series of concave dimples or recesses 235 that are a mirror of the eventual convex protuberances 218 formed in the blank 201' which, when driven upwardly and downwardly respectively, onto the blank 201', emboss the protuberances 218 into each side of the blank 201' to achieve the configuration shown in FIGS. 13 and 15. The remaining steps of the method of packing cigarettes described above in relation to the first embodiment of the invention are equally applicable to the pack of the third embodiment of the invention.

In either of the second or third embodiments of the invention, the protuberances may include any of the variations in shape, configuration, size and dimensions described above in reference to the protuberances of the first embodiment of the invention. Furthermore, the above-described embossing method or other methods of manufacture of the outwardly projecting protuberances of the first embodiment may equally be applicable to the manufacture of the second or third embodiments of the invention having protuberances.

Figure 16:
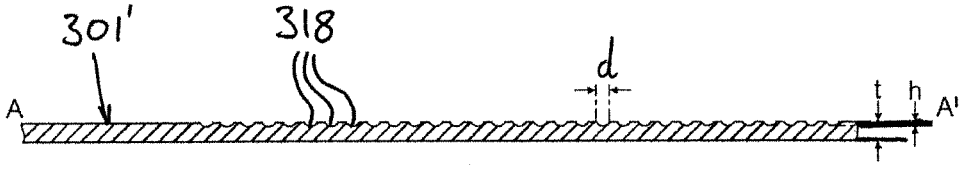
FIG. 16 is a partial cross-sectional view similar to that shown in FIG. 6, but of a blank of a fourth embodiment of the invention.
Figure 17:
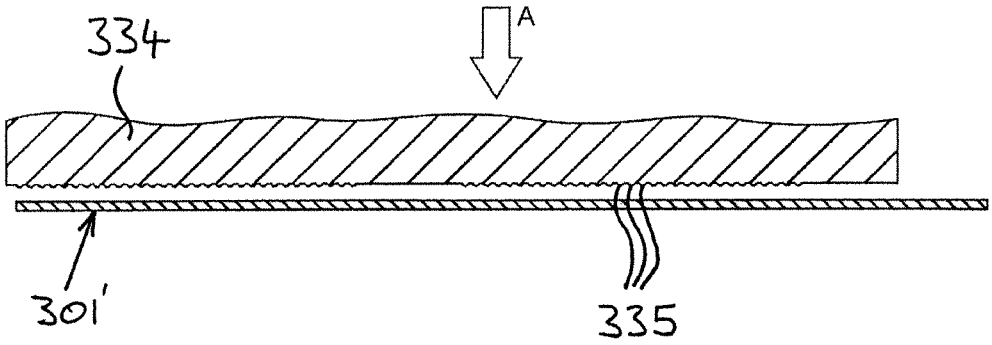
FIG. 17 is a schematic illustration of an embossing station similar to that shown in FIG. 8, but for use in producing the blank of the fourth embodiment of the invention shown in FIG. 16.
Figure 18:
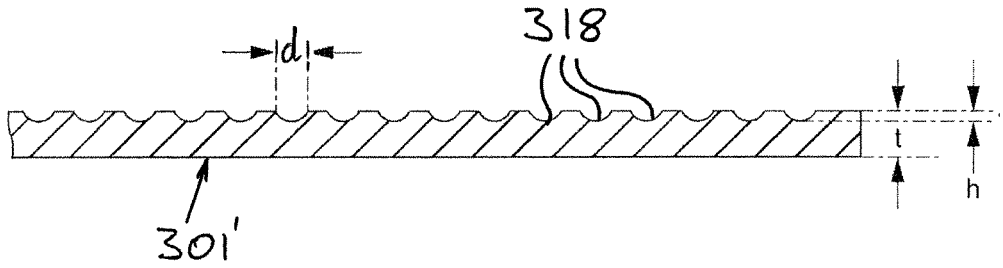
FIG. 18 is an enlarged view of a portion of the cross-section of the blank shown in FIG. 16.

In all of the first to third embodiments of the invention described above, the panel(s) of the packs include protuberances which project from the outer and/or inner surfaces thereof. However, it is envisaged within the scope of the invention that one or more panels of a pack of the invention may alternatively include a plurality of depressions extending into the surface of the panel(s), such as dimples or concavities, rather than projecting convex protuberances. Such an embodiment, a fourth embodiment of the invention, is shown in FIGS. 16 to 18, which show a portion of a blank 301' similar to blank 1' of the first embodiment shown in FIG. 5. However, FIGS. 16 and 18 show that panel is provided with a plurality of concave depressions or dimples 318 formed in one side of the blank 301' instead of projecting convex protuberances. This fourth embodiment of the invention also affords the technical advantage of providing air-gaps to insulate the cigarettes from the external heat source, namely each of the plurality of depressions 318 contains a small pocket of air between the wrapping and the outer surface of the panels. The sum of all of the small discrete pockets of air contained within the depressions 318 results in a significant total insulating air space which helps to prevent heat transfer from the exterior of the pack to the smoking articles within the pack, thereby minimizing heat-degradation of the smoking articles within the pack. As with the first to third embodiments of the invention, the depressions 318 of the fourth embodiment also serve to provide a tactile gripping surface to increase purchase on the surface of the pack by a user during opening and subsequent use of the pack.

As with the protuberances of the first to third embodiments, the depressions, shown here as concave dimples 318, of the fourth embodiment may be applied at an embossing station, which may utilize an embossing tool 334 as illustrated in FIG. 17. Here, the pre-printed blank 301' is placed in alignment with an embossing tool 334 (shown in section) which is moved in the direction of arrow A in order to emboss the surface of the blank 301'. The tool 334 include a series of convex domes or protuberances 335 that are a mirror of the eventual concave dimples 318 formed in the blank 301' which, when driven downwardly onto the blank 301', emboss the concave dimples 318 into the blank 301' to achieve the configuration shown in FIGS. 16 and 18. The remaining steps of the method of packing cigarettes described above in relation to the first embodiment of the invention are equally applicable to the pack of the fourth embodiment of the invention.

Figure 21:
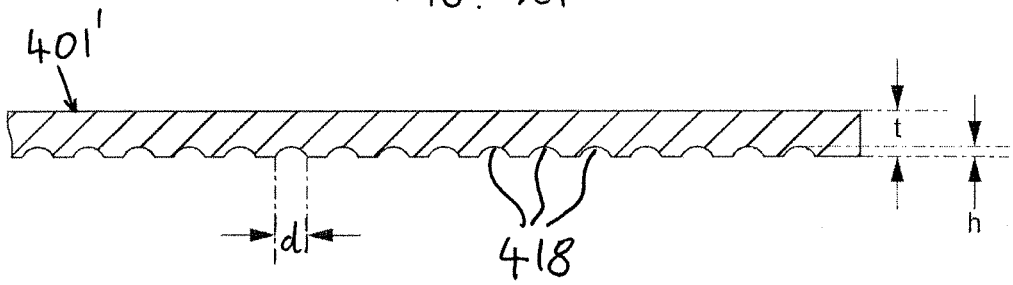
FIG. 21 is an enlarged view of a portion of the cross-section of the blank shown in FIG. 19.
Figure 19:
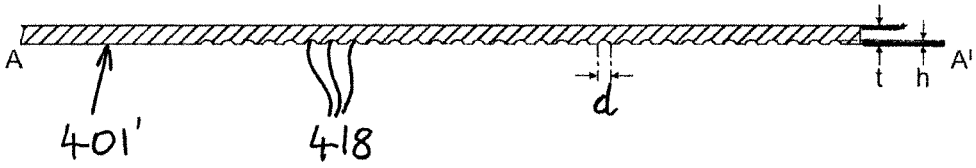
FIG. 19 is a partial cross-sectional view similar to that shown in FIG. 6, but of a blank of a fifth embodiment of the invention.
Figure 20:
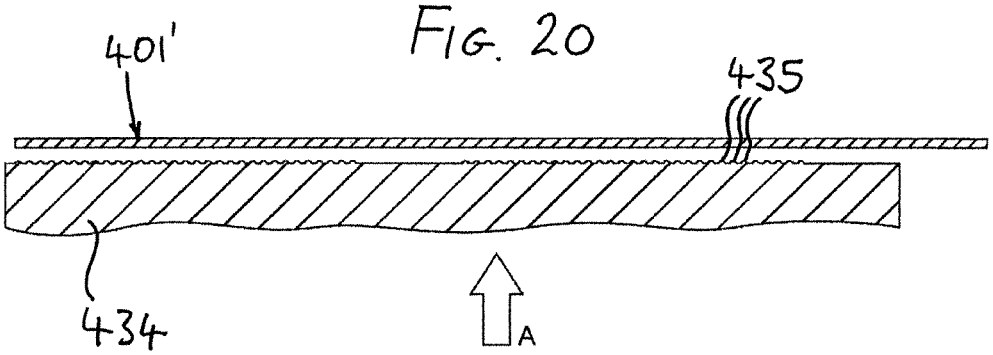
FIG. 20 is a schematic illustration of an embossing station similar to that shown in FIG. 8, but for use in producing the blank of the fifth embodiment of the invention shown in FIG. 19.

In the above-described fourth embodiment, the depressions are shown and described as being formed in and extending into the outer surfaces of the panels of the pack, thereby affording the technical advantages of creating a plurality of discrete insulating air gaps or pockets between the pack surface and the wrapping to prevent heat degradation of the smoking articles. However, it is intended within the scope of the invention that the depressions may extend into the inside surface(s) of the panels of the pack. Such an alternative, fifth embodiment of the invention is shown in FIGS. 19 to 21, which illustrate a portion of a blank 401' similar to blank 1' of the first embodiment. However, FIGS. 19 and 21 show that the blank 401' is provided with a plurality of concave depressions or dimples 418 instead of projecting convex protuberances. Also, the depressions, in the form of generally circular concavities 418, in this fifth embodiment are formed on the opposite side of the blank 401' to those of the blank 301' of the fourth embodiment of the invention. Therefore, once the blank 401' of the fifth embodiment is folded to produce a cigarette pack, the depressions 418 will extend into the inside surfaces of the panels of the pack, and so will provide a plurality of discrete air pockets between the foil-wrapped cigarettes, which are to be contained within the pack and the inside surface of the pack. These insulating air pockets help to prevent the conduction of heat from the panels of the pack to the foil-wrapped cigarettes within the pack. This therefore prevents the problems described above with heat-degradation of the smoking articles from occurring.

As with the depressions 318 of the fourth embodiment, the depressions 418 of the fifth embodiment may be applied at an embossing station, which may utilize an embossing tool 434 as illustrated in FIG. 20. Here, the pre-printed blank 401' is placed in alignment with an embossing tool 434 (shown in section) which is moved in the direction of arrow A in order to emboss the surface of the blank 401'. The tool 434 includes a series of convex domes or protuberances 435 that are a mirror of the eventual concave depressions 418 formed in the blank 401' which, when driven upwardly onto the blank 401', embosses the depressions 418 into the blank 401' to achieve the configuration shown in FIGS. 19 and 21. The remaining steps of the method of packing cigarettes described above in relation to the first embodiment of the invention are equally applicable to the pack of the fifth embodiment of the invention.

Figure 24:
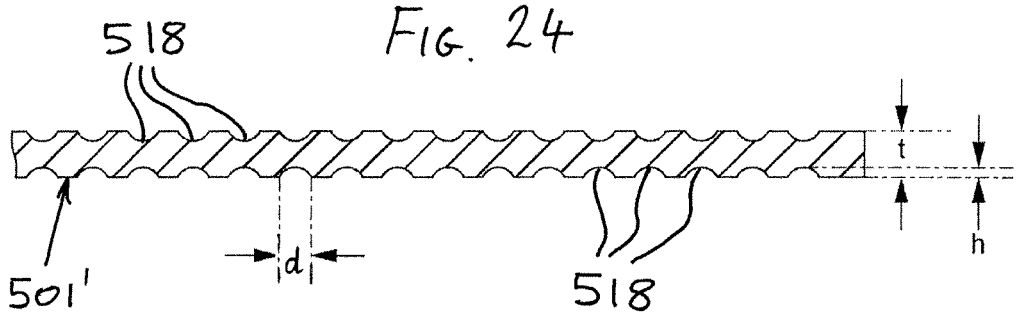
FIG. 24 is an enlarged view of a portion of the cross-section of the blank shown in FIG. 22.
Figure 22:
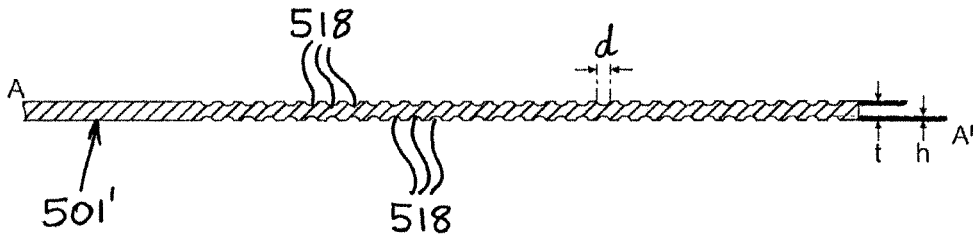
FIG. 22 is a partial cross-sectional view similar to that shown in FIG. 6, but of a blank of a sixth embodiment of the invention.
Figure 23:
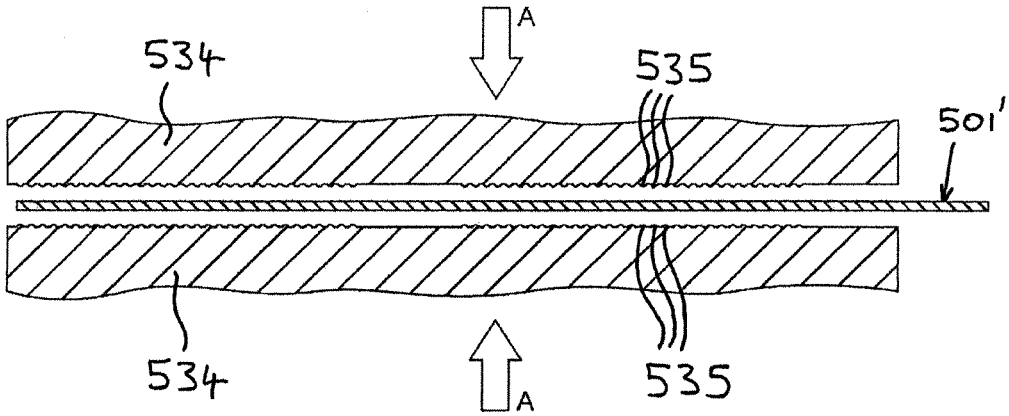
FIG. 23 is a schematic illustration of an embossing station similar to that shown in FIG. 8, but for use in producing the blank of the sixth embodiment of the invention shown in FIG. 22.

In the fifth embodiment shown in FIGS. 19 to 21, the depressions 418 are provided on the inside of the pack, in place of the depressions 318 on the outside of the pack shown and described in the fourth embodiment of FIGS. 16 to 18. However, the depressions, such as concave dimples, may be provided on the inside surface of the pack as well as on the outside surface of the pack, and such an embodiment, a sixth embodiment of the invention, is shown in FIGS. 22 to 24, which show a portion of a blank 501' similar to blanks 301' and 401' of the fourth and fifth embodiments. However, FIGS. 22 and 24 show that depressions 518 in this sixth embodiment are formed on both sides of the blank 501', such that when the pack is folded and constructed, the pack has depressions in the form of concave dimples, extending into both the inside and the outside surfaces of the panels of the pack. This affords the sixth embodiment of the invention with the increased technical advantage of two sets of a plurality of discrete insulating air-pockets to insulate the cigarettes from the external heat source, namely a first set of air pockets between the wrapping and the outside surface of the panels provided by the depressions 518 in the outside surface of the panels of the pack, as with the fourth embodiment of the invention, and a second set of air pockets provided between the inside surface of the panels and the foil-wrapped cigarettes provided by the depressions 518 in the inside surface of the panels of the pack, as with the fifth embodiment of the invention.

As with the protuberances 318,418 of the fourth and fifth embodiments, the depressions 518 of the sixth embodiment may be applied at an embossing station, which may utilize an embossing tool 534 as illustrated in FIG. 23. Here, the pre-printed blank 501' is placed in alignment with an embossing tool 534 (shown in section) which is moved in the direction of arrows A in order to emboss the surfaces of the blank 501'. The two parts of the tool 534 include a series of convex domes or protuberances 535 that are a mirror of the eventual concave depressions or dimples 518 formed in each side of the blank 501' which, when driven upwardly and downwardly respectively, onto the blank 501', emboss the depressions 518 into each side of the blank 501' to achieve the configuration shown in FIGS. 22 and 24. The remaining steps of the method of packing cigarettes described above in relation to the first embodiment of the invention are equally applicable to the pack of the sixth embodiment of the invention.

In any of the fourth to sixth embodiments of the invention, the depressions may vary in shape, configuration and size within the scope of the invention. In the exemplary embodiments, the depressions are shown in FIGS. 16, 18, 19, 21, 22 and 24, as having a diameter d which is typically of the order of 1.0-1.5 mm, and a depth h which is typically of the order of 0.1-0.2 mm, measured from the base, un-embossed surface of the front and rear panels. The panels have a typical un-embossed thickness t of approximately 0.3 mm, although the thickness of the panels may vary within the scope of the invention. The number of depressions on each panel may also vary within the scope of the invention, and may be from 5-2,000, conveniently from 10-1,000 and more conveniently from 50-750.

Figure 25:
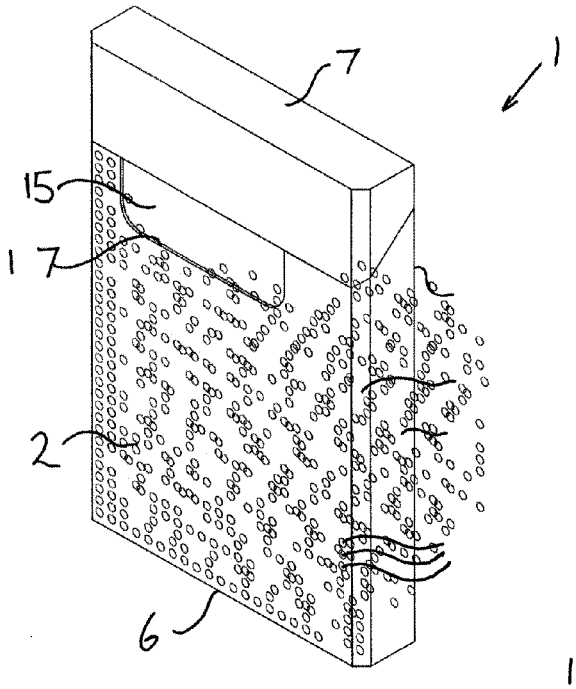
FIG. 25 is a perspective view of a cigarette pack of a seventh embodiment of the invention from the front and one side with its lid closed.
Figure 26:
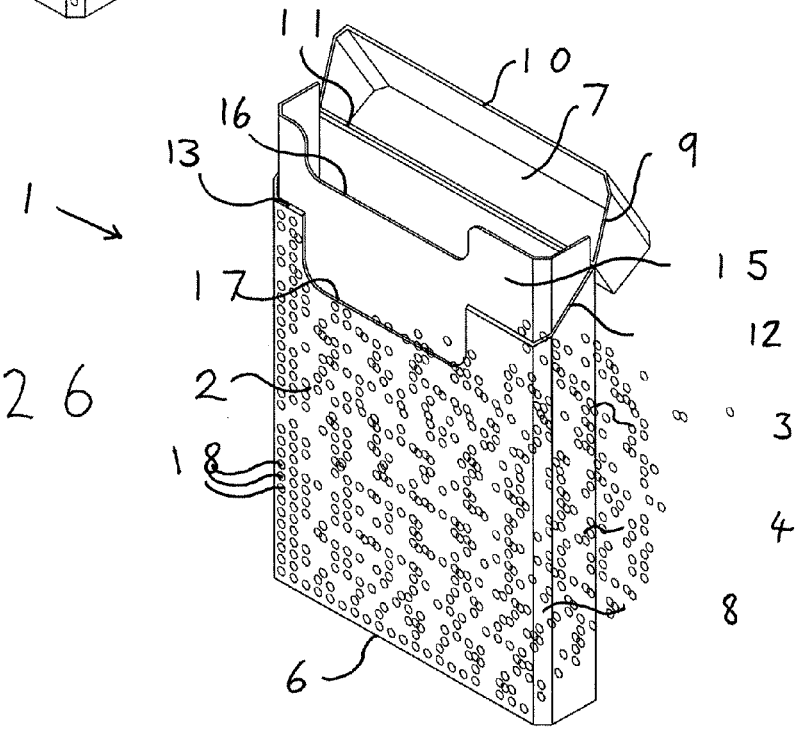
FIG. 26 shows the pack of FIG. 25 with the lid open.
Figure 27:
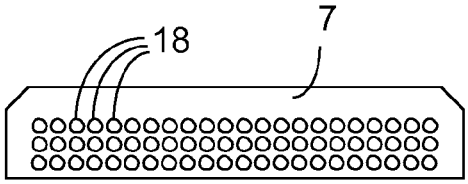
FIG. 27 is a top view of the pack in an embodiment of the invention.
Figure 31:
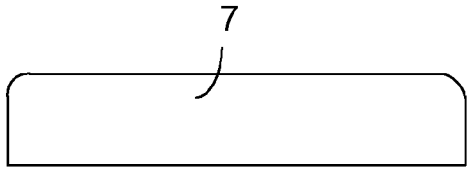
FIG. 31 is a top view of the pack showing curved edges in one embodiment of the invention.
Figure 28:
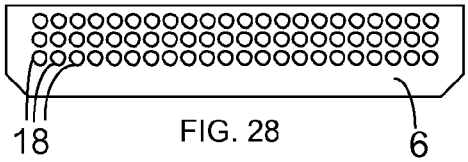
FIG. 28 is a bottom view of the pack in an embodiment of the invention.
Figure 29:
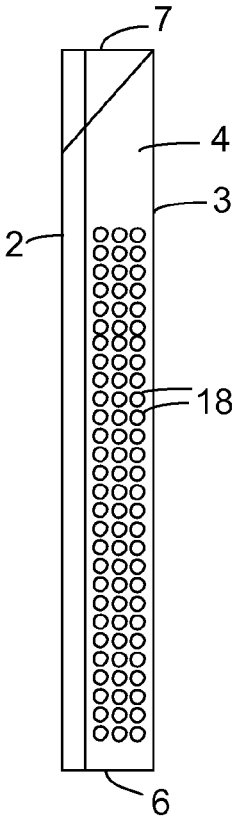
FIG. 29 is a right side view of the pack in an embodiment of the invention.
Figure 30:
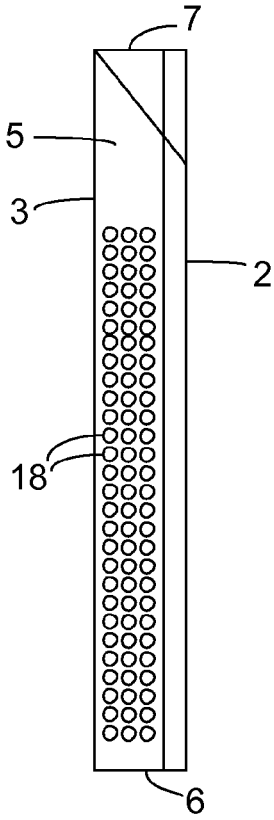
FIG. 30 is a left side view of the pack in an embodiment of the invention.
Figure 32:
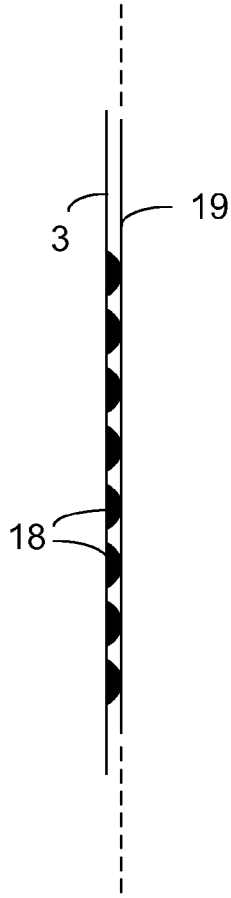
FIG. 32 is an enlarged side view showing a portion of the pack wrapped with an outer wrapper in an embodiment of the invention.
Figure 33:
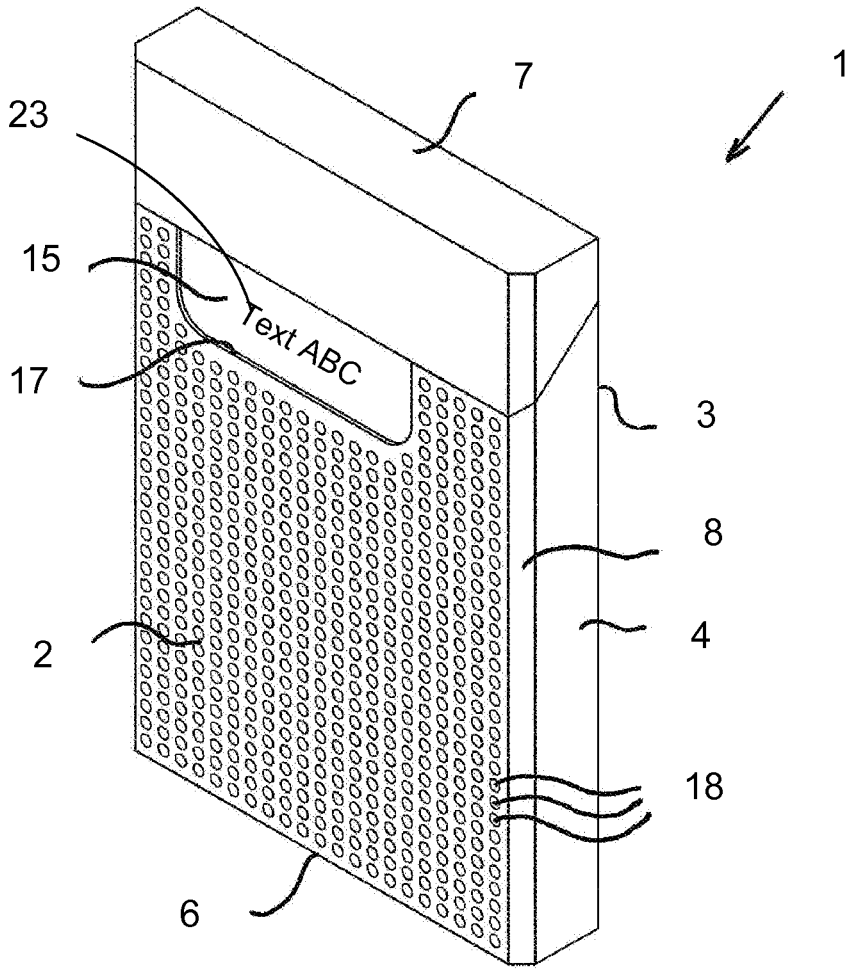
FIG. 33 shows the pack of FIG. 25 with printed indicia or graphics in one embodiment of the invention.
Figure 34:
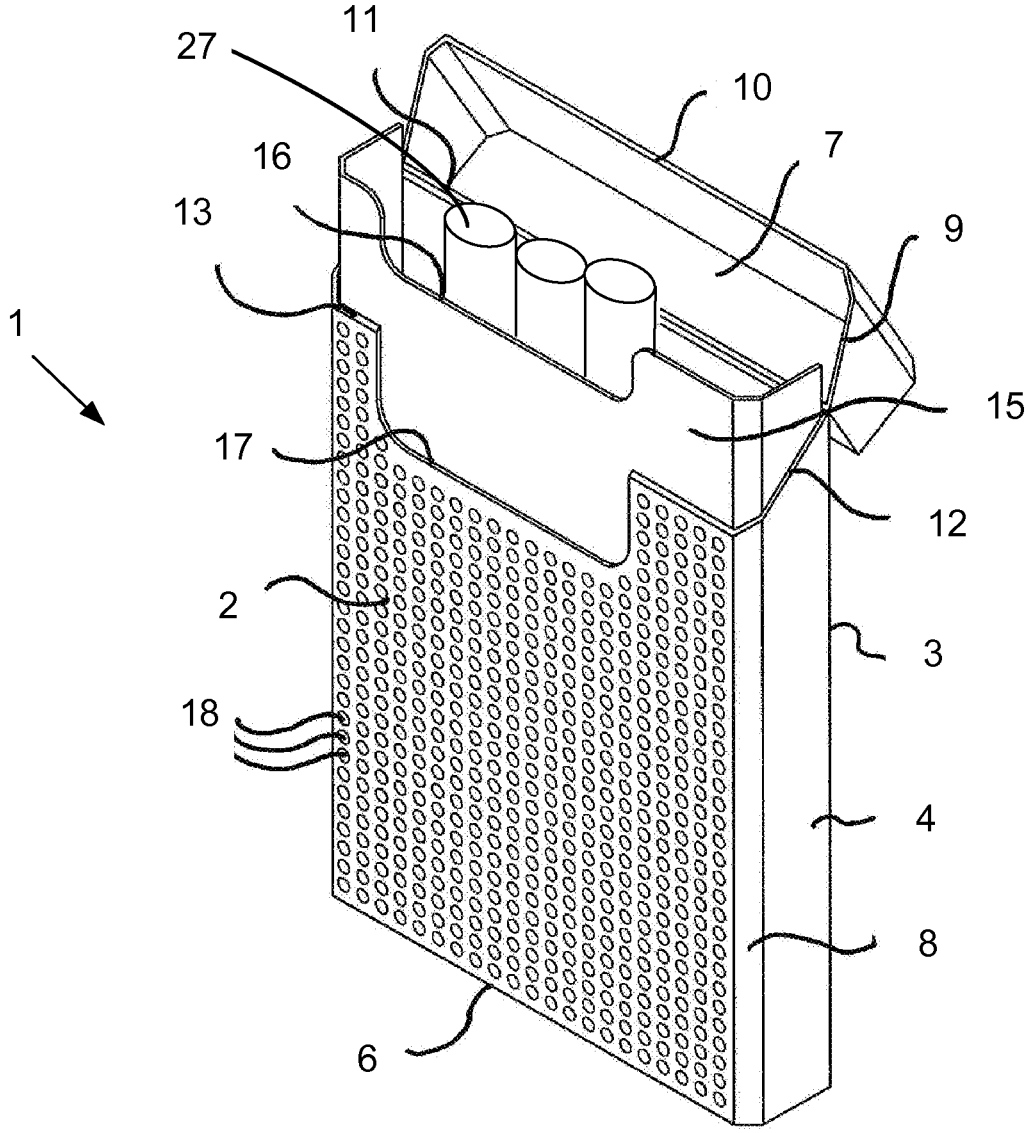
FIG. 34 shows the pack of FIG. 26 containing smoking articles in one embodiment of the invention.
Figure 35:
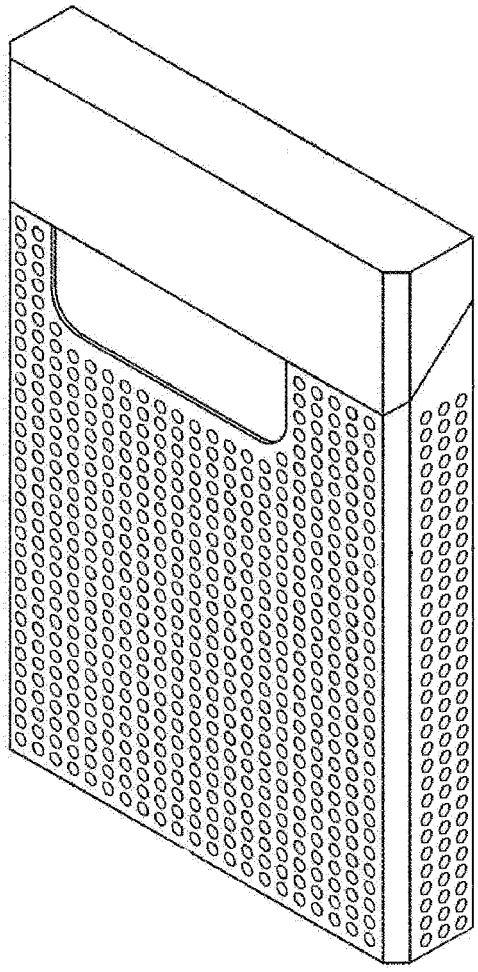
FIG. 35 is a perspective view of one embodiment.
Figure 36A:
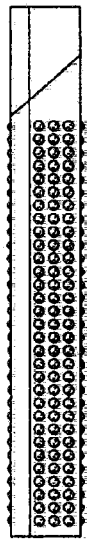
FIGS. 36A and 36B are side views of an embodiment.
Figure 36B:
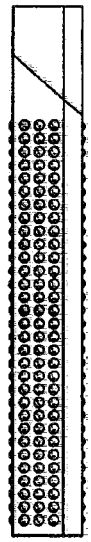
Figure 37:
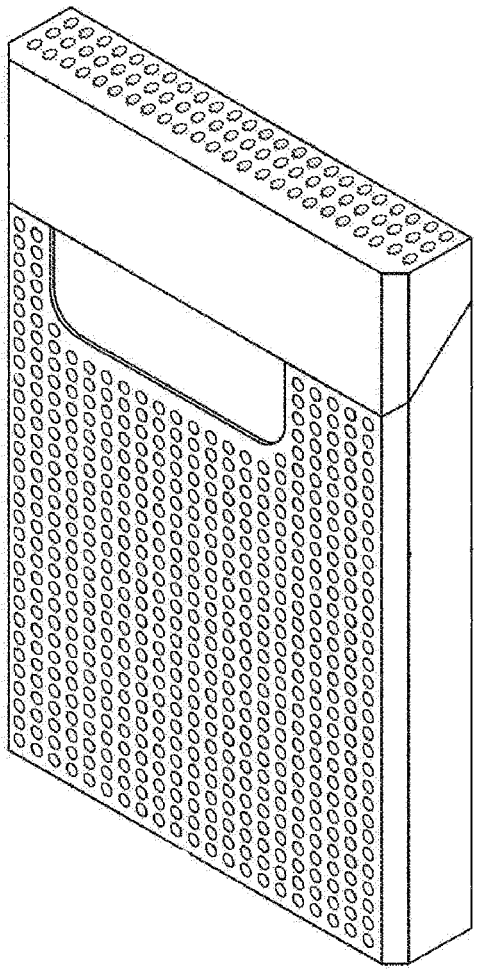
FIG. 37 is a perspective view of an embodiment.
Figure 38A:
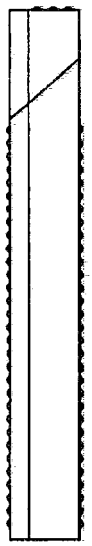
FIGS. 38A and 38B are side views of an embodiment.
Figure 38B:
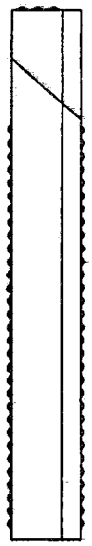
Figure 39:
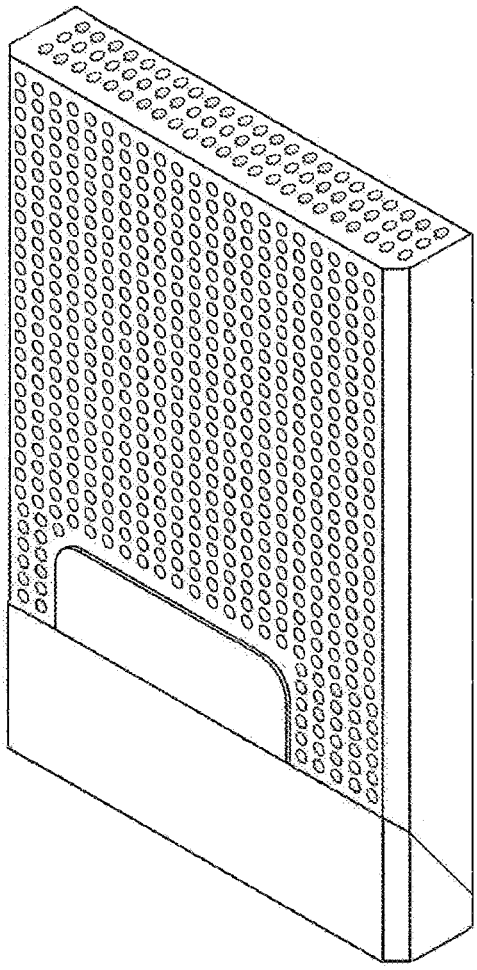
FIG. 39 is a perspective view of an embodiment.
Figure 40A:
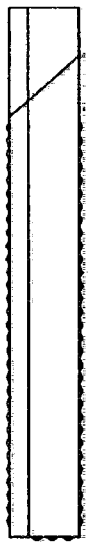
FIGS. 40A and 40B are side views of an embodiment.
Figure 40B:
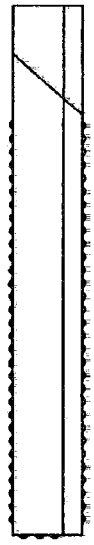

A seventh embodiment of the present invention is shown in FIGS. 25 and 26 and is generally the same as the first embodiment shown in FIGS. 1-4, and is described hereafter with like features retaining the same reference numerals. An inner frame 15 of board stock sheet material such as cardboard is fitted within the upper part of the opening of the pack e.g. by gluing, and includes a re-entrant part 16 to provide user access to the cigarettes 27. The inner frame 15 is of a shape to bound the interior of the front and side panels 2, 4, 5 along with the beveled edges 8 adjacent the front panel so as to act as a jam against which the lid 7 can abut when closed, with its exterior surface co-extensive with the front and side panels 2, 4, 5. The inner frame 15 includes depending flanges (not shown) which act as stops to hold the lid 7 when closed. However, the seventh embodiment shown in FIGS. 25 and 26 differs from that of the first embodiment illustrated in FIGS. 1-4 in that the front panel 2 includes a cut-out or re-entrant section 17 at its upper edge 13 which exposes a portion of the inner frame 15 when the lid 7 is closed. The exposed portion of the inner frame 15 can be provided with printed indicia or graphics 23. In addition, the re-entrant section 16 of the inner frame 15 is located above the cut-out or re-entrant section 17 in the front panel 2. The re-entrant section 16 in the inner frame 15 can facilitate the removal of cigarettes from the pack by a user, by exposing a larger surface area of the top of the cigarettes, to improve purchase on the cigarette.

Many modifications and variations of the described packs fall within the scope of the invention. For example, the number of protuberances or depressions and the arrangement of protuberances or depressions on the front and rear panels of the pack may be different. Also, not all of the front panel need be provided with the protuberances or depressions and instead, protuberances or depressions may be provided in discrete areas of one or more panels, whilst still providing the advantages described above.

In addition, the exact diameter d and height h of the protuberances or depressions may vary within the scope of the invention, and although the protuberances or depressions are shown as being round, various other shaped protuberances or depressions may equally be provided, for example, oval, square, rectangular, triangular, etc. Furthermore, not all of the protuberances or depressions need to be the same size and/or shape on the pack, and could vary across the panel(s). Such variations of protuberances would still result in a pack having the raised outer surface and tactile surface providing the above-mentioned technical advantages, which are provided by the embodiments of the invention having round protuberances, described above. Furthermore, such variations of depressions would still result in a pack having the a plurality of discrete insulating air-pockets and tactile surface providing the above-mentioned technical advantages, which are provided by the embodiments of the invention having round depressions, described above.

Furthermore, although the described packs have beveled edges, the edges may be of an alternative shape, such as rectangular or curved.

The packs shown and described in the exemplary embodiments are slim packs designed to contain slim or superslim cigarettes. However, the invention is not limited to a pack having such dimensions, and may equally be applied to any other shaped pack, including conventional kingsize cigarette pack sizes generally designed to contain twenty kingsize cigarettes.

Also, the embossing tools for the embossing station could be a rotary embossing device and other ways of creating the protuberances or depressions will be apparent to those skilled in the art, which do not necessarily involve embossing. Also, the blanks may be pre-formed with the protuberances or depressions at the time of manufacture so that the blanks held in the magazine already have the protuberances or depressions, which avoids the need for the embossing station.

In the described examples, the protuberances or depressions are provided on both of the front and rear panels. However, they may also be provided on only the front or the rear panel, or also on the base panel and/or side panels, as well as on the lid, or any combination thereof.

Any of the card weights and dimensions described above in relation to the first embodiment, equally may apply to the second to seventh embodiments of the invention.

Whilst the invention has been described in relation to a flip-top pack it can be used in connection with other packs for smoking articles which do not necessarily have a lid, for example a container that holds a plurality of flip-top cigarette packs.

Many other modifications and variations will be evident that fall within the scope of the following claims.

The entirety of this disclosure (including the Cover Page, Title, Headings, Field, Background, Summary, Brief Description of the Drawings, Detailed Description, Claims, Abstract, Figures, and otherwise) shows by way of illustration various embodiments in which the claimed inventions may be practiced. The advantages and features of the disclosure are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the structure of any combination of any components, other components and/or any present feature sets as described in the figures and/or throughout are not limited to a fixed order and/or arrangement, but rather, any disclosed order is exemplary and all equivalents, regardless of order, are contemplated by the disclosure. As such, some of these features may be mutually contradictory, in that they cannot be simultaneously present in a single embodiment. Similarly, some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, logical, organizational, structural, topological, and/or other aspects of the disclosure are not to be considered limitations on the disclosure as defined by the claims or limitations on equivalents to the claims.

What is claimed is:

1. A pack for smoking articles, comprising:

a plurality of primary and secondary planar panels configured to form a pack; and a two dimensional array of discrete formations spaced apart from each other and extending out of the plane of at least one surface of at least one of the primary planar panels;

wherein the array of discrete formations comprises protuberances projecting from the at least one surface of the at least one panel;

wherein the panel thickness at a formation is greater than the panel thickness between formations;

wherein the pack further comprises an outer wrapper, the outer wrapper spaced from the at least one surface of the at least one panel of the pack by said protuberances;

wherein the discrete formations are circular convex protuberances; and wherein each protuberance is spaced from the nearest adjacent protuberance by a distance less than the diameter of the protuberance.

2. The pack according to claim 1, wherein the plurality of primary panels comprises front and rear panels connected by secondary panels including opposite side panels, a bottom panel and a top panel, and wherein at least one of the front and rear panels includes the formations.

3. The pack according to claim 2, wherein both the front and rear panels include the formations.

4. The pack according to claim 2, wherein the side panels include the formations.

5. The pack according to claim 2, wherein the top panel includes the formations.

6. The pack according to claim 2, wherein the bottom panel includes the formations.

7. The pack according to claim 2, wherein the top panel comprises a lid.

8. The pack according to claim 7, wherein the lid comprises a flip top.

9. The pack according to claim 1, wherein the formations are embossments.

10. The pack according to claim 1, wherein the pack is fabricated from sheet material and the formations are formed in the thickness of the sheet material.

11. The pack according to claim 10, wherein the sheet material comprises cardboard.

12. The pack according to claim 1, wherein the formations are formed on substantially the entire surface area of the at least one panel.

13. The pack according to claim 1, wherein the formations are formed on only a portion of the surface area of the at least one panel.

14. The pack according to claim 1, wherein the protuberances project from at least one outer surface of the at least one panel.

15. The pack according to claim 1, wherein the protuberances project from at least one inner surface of the at least one panel.

16. The pack according to claim 1, wherein the protuberances project from at least one outer surface and at least one inner surface of the at least one panel.

17. The pack according to claim 1, wherein the at least one panel includes between 5 and 2000 protuberances.

18. The pack according to claim 17, wherein the at least one panel includes between 10 and 1000 protuberances.

19. The pack according to claim 18, wherein the at least one panel includes between 50 and 750 protuberances.

20. The pack according to claim 1, wherein all of the protuberances project from the at least one surface of the at least one panel by the same distance.

21. The pack according to claim 1, wherein the protuberances are formed in regular rows and columns on the at least one surface of the at least one panel.

22. The pack according to claim 21, wherein the at least one panel includes between 5 and 2000 protuberances.

23. The pack according to claim 22, wherein the at least one panel includes between 10 and 1000 protuberances.

24. The pack according to claim 23, wherein the at least one panel includes between 50 and 750 protuberances.

25. The pack according to claim 1, further comprising:

an inner frame within the pack.

26. The pack according to claim 25, wherein the pack comprises a front panel which includes a cut-out portion which exposes a portion of the inner frame.

27. The pack according to claim 26, wherein the exposed portion of the inner frame is printed with one of indicia and graphics.

28. The pack according to claim 1, wherein corner edges of the pack are beveled.

29. The pack according to claim 1, wherein corner edges of the pack are curved.

30. The pack according to claim 1, wherein corner edges of the pack are rectangular.

31. The pack according to claim 1, wherein the pack contains smoking articles.

32. The pack according to claim 31, wherein the smoking articles comprise cigarettes.

33. A method of fabricating a pack for smoking articles from a blank comprising a plurality of planar panel portions, the method comprising:

forming in at least one of a plurality of planar panel portions a two dimensional array of discrete formations, said formations being spaced apart from each other and extending out of the plane of at least one surface of at least one of the planar panel portions;

wherein the array of discrete formations comprises protuberances projecting from the at least one surface of the at least one panel portion;

wherein the panel thickness at a formation is greater than the panel thickness between formations;

wherein the pack further comprises an outer wrapper, the outer wrapper spaced from the surface of the at least one panel of the pack by said protuberances;

wherein the discrete formations are circular convex protuberances; and wherein each protuberance is spaced from the nearest adjacent protuberance by a distance less than the diameter of the protuberance.

34. The method according to claim 33, further comprising embossing a blank to form the formations.

35. The method according to claim 34, further comprising:

feeding successive blanks from a magazine to an embossing station to form said formations; and feeding the embossed blanks to a cigarette packaging machine to be formed into packs filled with cigarettes.

36. The method according to claim 35, further comprising:

wrapping the pack in an outer wrapping subsequent to the packs being filled with cigarettes;

sealing the wrapping onto the pack using heat from a heater element; and forming an air gap between the wrapping and the surface of the pack via the plurality of protuberances spacing the wrapping from the pack surface.

37. The method according to claim 35, wherein the blank comprises front and rear panel portions, side panel portions, a bottom panel and a portion to form a lid.

38. The method according to claim 37, further comprising:

wrapping the pack in an outer wrapping subsequent to the packs being filled with cigarettes, sealing the wrapping onto the pack using heat from a heater element; and forming a plurality of air gaps between the wrapping and the surface of the pack within the plurality of protuberances spacing the wrapping from the pack surface.

39. A pack for smoking articles, comprising:

a plurality of planar pack panels fabricated from a sheet material and configured to form a pack, wherein the sheet material comprises cardboard;

wherein the plurality of pack panels comprises:

primary pack panels including a front pack panel and a rear pack panel; and secondary pack panels including side pack panels and a top pack panel, the top pack panel comprising a lid and a bottom pack panel; and wherein the front pack panel and rear pack panel are connected by the side pack panels, bottom pack panel, and top pack panel to form the pack;

a two dimensional array of discrete and embossments that are spaced apart from each other and extend out of the plane of a surface of at least one of the primary planar pack panels, wherein the formations are circular convex protuberances in which each protuberance is spaced from the nearest adjacent protuberance by a distance less than the diameter of the protuberance, wherein the panel thickness at a formation is greater than the panel thickness between formations; and wherein the at least one primary planar pack panel surface has between 50 and 750 embossments; and an outer wrapper for the pack, wherein the outer wrapper is spaced from the surface of the at least one primary planar pack panel of the pack by said array of embossments.

* * * * *

UNITED STATES PATENT AND TRADEMARK OFFICE

CERTIFICATE OF CORRECTION

PATENT NO. : 8,607,974 B2
APPLICATION NO. : 12/341810
DATED : December 17, 2013
INVENTOR(S) : Tanneguy Blaudin de The, John England and Steven Holford It is certified that error appears in the above-identified patent and that said Letters Patent is hereby corrected as shown below:

Title Page:

Item (73) Assignee:

"British America Tobacco (Holdings) Limited" should be changed to
-- British-American Tobacco (Holdings) Limited --

Signed and Sealed this
Twenty-ninth Day of April, 2014

Michelle K. Lee

Michelle K. Lee
*Deputy Director of the United States Patent and Trademark Office*